US005947501A

United States Patent [19]

Osborn

[11] Patent Number: 5,947,501

[45] Date of Patent: Sep. 7, 1999

[54] WHEELCHAIR ATTACHABLE TRANSFER BOARD AND ARMREST COMBINATION

[76] Inventor: Robert Kent Osborn, 118 Northmor Rd., Casselberry, Fla. 32707

[21] Appl. No.: 08/705,127

[22] Filed: Aug. 29, 1996

[51] Int. Cl.[6] ..... A61G 7/08

[52] U.S. Cl. ..... 280/304.1; 5/81.1 HS; 108/49

[58] Field of Search ..... 280/250.1, 304.1; 5/81.1 R, 81.1 RP, 81.1 HS; 108/4, 44, 49

[56] References Cited

U.S. PATENT DOCUMENTS

| | | | |
|---|---|---|---|
| 1,635,575 | 7/1927 | Cole | 5/81.1 HS |
| 2,509,551 | 5/1950 | Woods | 5/81.1 R |
| 2,710,051 | 6/1955 | Greenberg | 104/4 |
| 2,915,112 | 12/1959 | Schwartz | 5/81.1 HS |
| 4,155,588 | 5/1979 | Danziger et al. | 5/81.1 R |
| 4,908,890 | 3/1990 | Beckman et al. | 5/81.1 R |
| 5,207,549 | 5/1993 | Riva | 414/340 |
| 5,326,154 | 7/1994 | Williamson et al. | 297/411.36 |

*Primary Examiner*—Kevin Hurley
*Attorney, Agent, or Firm*—Christensen O'Connor Johnson & Kindness PLLC

[57] ABSTRACT

A wheelchair with a detachable combined armrest and transfer board. The transfer board is attached to the wheelchair by a unique coupling. The transfer board is linked to the seating surface of the wheelchair and is reconfigurable from a first position in which the transfer board extends along one side of the seating surface to a second position in which the transfer board is capable of extending from the seating surface of the wheelchair to a second seating surface remote of the wheelchair. The coupling permits unrestricted movement of the transfer board relative to the wheelchair while maintaining a linkage between the wheelchair and the transfer board, thus aiding in stability of the transfer board.

8 Claims, 4 Drawing Sheets

WHEELCHAIR ATTACHABLE TRANSFER BOARD AND ARMREST COMBINATION

FIELD OF THE INVENTION

This invention relates generally to wheelchair components that provide more functional wheelchair use and, more specifically, to a transfer board and apparatus which attach to a wheelchair and can be positioned vertically and used as an armrest.

BACKGROUND OF THE INVENTION

A transfer board is a thin tapered board used as a bridge for an individual to scoot from one armless chair, bed, or seating surface to another. The transfer boards are often used by individuals that have a limited ability to bear weight directly on their lower extremities. This inability can be due to amputation, lack of sufficient muscular control (such as with a spinal cord injury, stroke, M.S., etc.), or lack of balance and coordination (such as with stroke or traumatic brain injury).

Most wheelchairs are equipped with removable armrests to facilitate the use of transfer boards, if needed. The armrest is removed and the transfer board is positioned to extend from the seating surface of the wheelchair to the surface upon which the wheelchair occupant plans to move. The degree of independence exhibited by an individual using a transfer board is governed by his or her ability to: reach and control the transfer board with one or both upper extremities; position the wheelchair and remove the armrest; shift weight and place the transfer board underneath the buttocks; bear weight with upper extremities and slide across the transfer board; remove the transfer board at the conclusion of transfer; and overcome the fear of falling to allow for all of the aforementioned tasks.

One problem encountered in these transfers is an inability of the wheelchair user to remove and reattach the armrest to the wheelchair. The user must use visual or tactile skills to locate the spring pin which locks the armrest to the wheelchair. Then, the user must release and lift the armrest from its attachments on the wheelchair (often with the use of only one arm), and place the armrest aside where it is accessible for reattachment. The user must then reattach the armrest after returning to the wheelchair. In the cases of memory and motor deficits or tremors, the tasks of releasing the armrest and guiding it in and out of its two cylindrical attachments (one of which is outside the view of the individual) is often difficult.

For stability, 5 to 8 inches of the transfer board is typically placed underneath the transferee prior to transfer. It is often difficult for the transferee to shift weight and place the transfer board this far underneath the buttocks. Even with proper placement, the board can still slide laterally with the transferee, precipitating a fall.

Because transfers are rarely between surfaces of equal height, transfer boards tend to shift unnecessarily when weight is shifted during a transfer from a higher to a lower surface. This can cause the above-described lateral sliding of the transfer board. For individuals with limited mobility, the possibility of failing is a very justifiable concern. Knowing that the transfer board is securely attached at one location would be of great benefit.

Another problem with transfer boards is transportation. Few wheelchair dependent individuals can reach, place, and remove the transfer board from a backpack/holder behind the wheelchair. Thus, unless the wheelchair occupant anticipates having assistance, he or she must carry the three foot transfer board on his or her lap. This positioning of the transfer board inhibits arm propulsion of the wheelchair.

It is the objective of this invention to enhance safety and independence by addressing all of these problems. This invention combines the armrest of a wheelchair and a transfer board into one easily manipulated and transported unit. The benefits of the device become more evident when the following detailed description is taken in conjunction with the illustrations.

SUMMARY OF THE INVENTION

In accordance with this invention, a wheelchair with a detachable combined armrest and transfer board device is provided. The device permits greater ease in use of a transfer board by a person with limited mobility and motor control.

More particularly described, the present invention provides a coupling for attaching a device to a base. The coupling includes a rod slidably attached to the base, a pivot joint attached to the rod, and a swivel joint attaching the pivot joint to the device. The pivot joint permits 180° pivoting of the device about the rod. The swivel joint permits 360° independent rotation of the transfer board. Preferably, the swivel joint and the pivot joint are collocated.

The present invention further provides a wheelchair having a seating surface and a transfer board linked to the seating surface. The transfer board is reconfigurable from a first position in which the transfer board extends along one side of the seating surface to a second position in which the transfer board is capable of extending from the seating surface of the wheelchair to a second seating surface remote of the wheelchair. The transfer board may thereby aid in transfer of a wheelchair patient from the sitting surface of the wheelchair to the second seating surface. The transfer board may be attached to the wheelchair by the coupling described above, and is preferably attached to the front armrest receiving cylinder. Preferably, a removable armrest is provided which is selectively attachable to the transfer board when the transfer board is in the first position. The removable armrest includes a longitudinal cavity for fitting over the transfer board.

The present invention also provides a device for transferring an individual from a first seating surface to a second seating surface, the device having a transfer board linked to the first seating surface and reconfigurable from a first position in which the transfer board extends along one side of the first seating surface to a second position in which the transfer board is capable of extending from the first seating surface to the second seating surface. The transfer board may thereby aid in transfer of a wheelchair patient from the first seating surface to the second seating surface.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
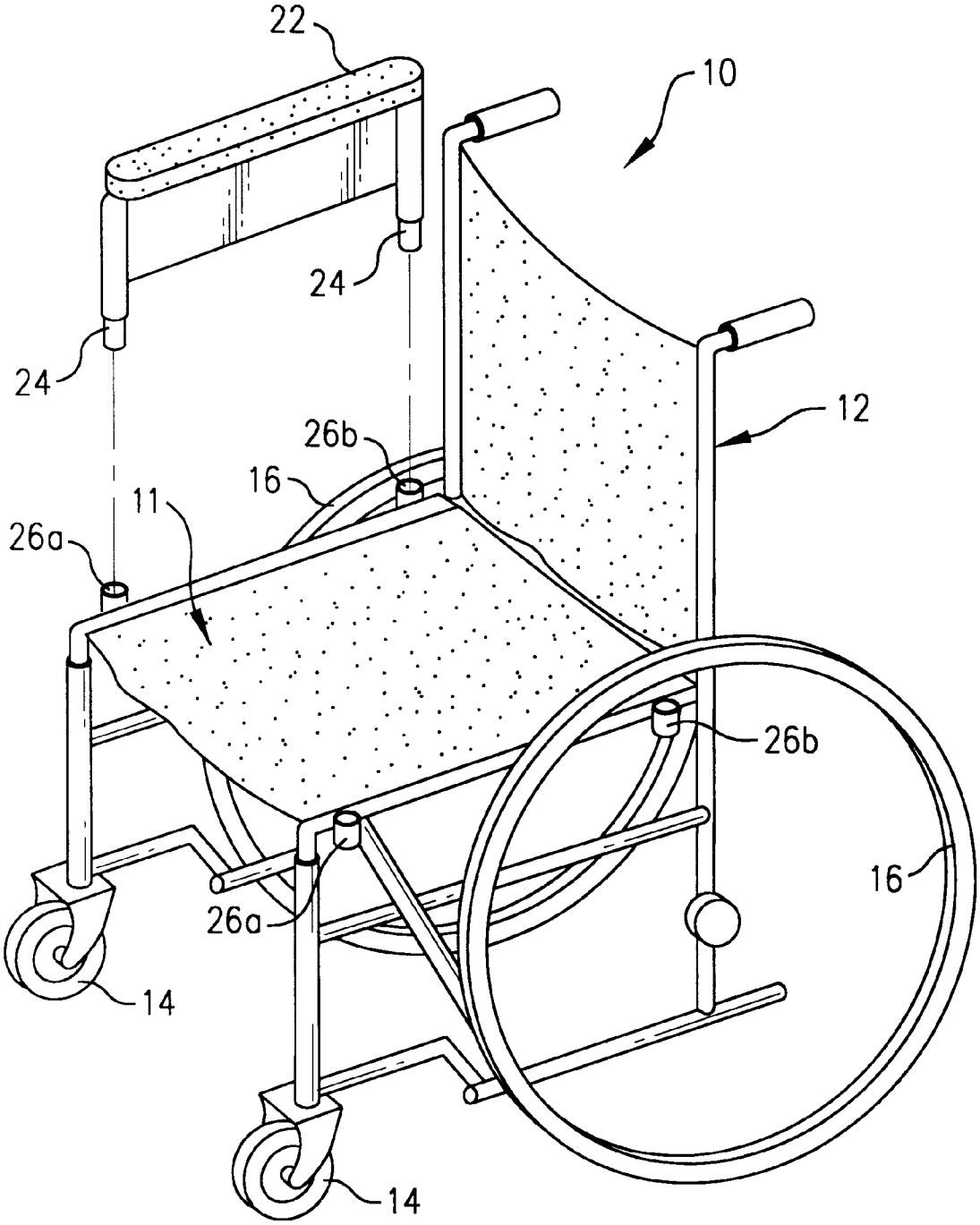
FIG. 1 is a side perspective view of a prior art wheelchair design with a removable armrest.

FIG. 1 illustrates a prior art wheelchair 10. The wheelchair 10 is preferably a collapsible type well known in the medical industry, and includes a seating surface 11, a back 12, front wheels 14, and rear wheels 16. A rigid armrest 22 is shown in FIG. 1 for attachment to the right side of the seating surface 11. Although only one rigid armrest 22 is shown in the drawing, another armrest is typically provided on the opposite side of the wheelchair 10 and is a mirror image of the one shown. The rigid armrest 22 has tapered posts 24 which are adapted to slide into front and rear armrest receiving cylinders 26A and 26B. The armrest receiving cylinders 26A and 26B are attached to the wheelchair frame by a vertical and rectangular connector (not shown, but well known in the art). Generally, the tapered posts 24 of the rigid armrest 22 and armrest receiving cylinders 26A and 26B lock to each other by a spring (not shown, but well known in the art), which is either internal to the tapered posts 24 or external to the receiving cylinders 26A and 26B on the wheelchair 10.

Figure 2:
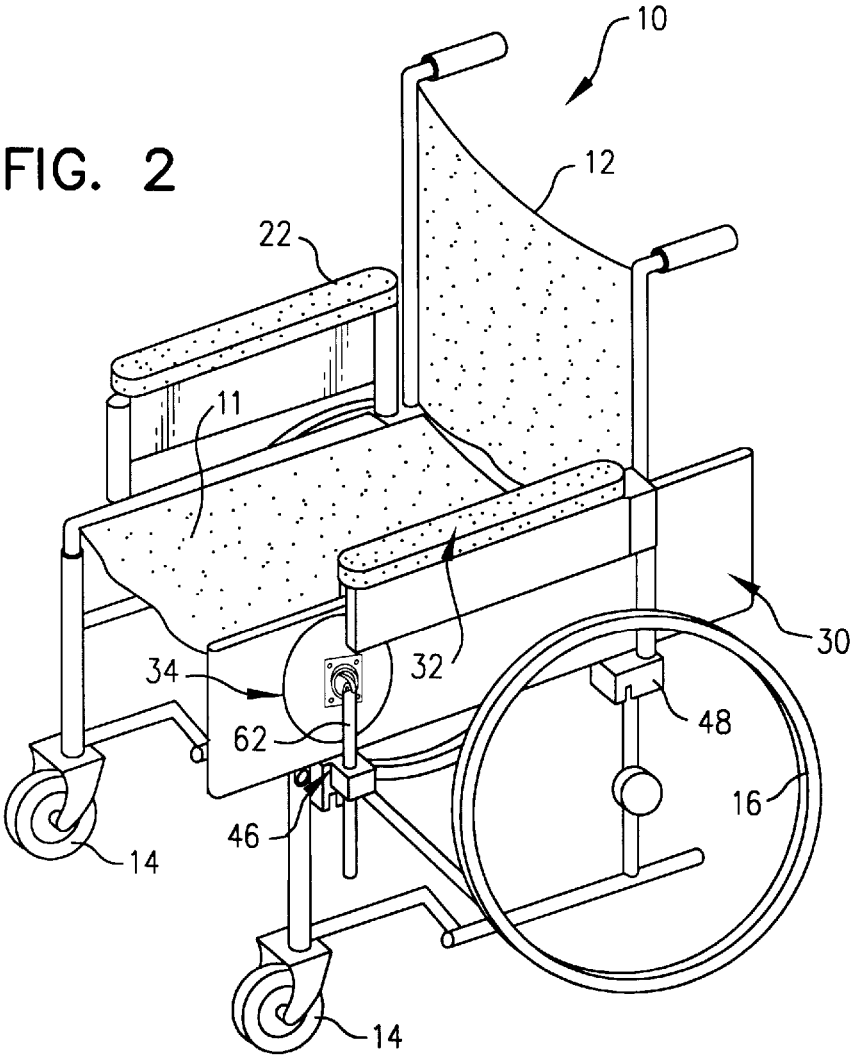
FIG. 2 is a side perspective view of a wheelchair having a transfer board incorporating the present invention, the transfer board being mounted in the stowed or vertical position.
Figure 7:
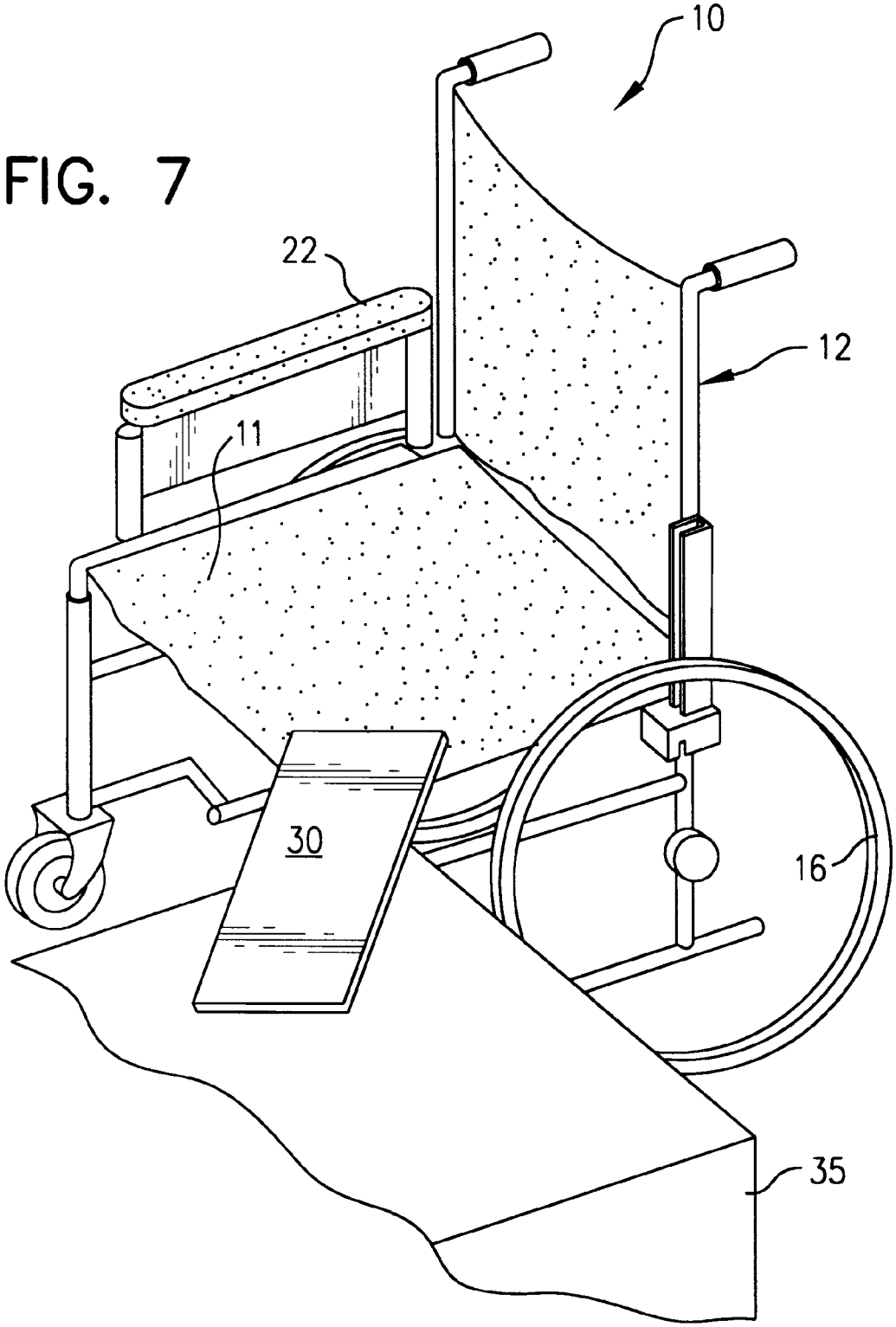
FIG. 7 is a side perspective view of a wheelchair having a transfer board incorporating the present invention, with the transfer board in the transfer position and extended to a seating surface, such as a bed.

FIG. 2 illustrates a combined transfer board 30 and removable armrest 32 embodying the present invention. As shown in FIG. 2, the transfer board 30 is vertically positioned along the left side of the wheelchair 10. The removable armrest 32 is positioned along the top longitudinal edge of the transfer board 30 and is removably attached to the transfer board. Briefly described, the transfer board 30 is attached to the wheelchair 10 by a rotatable and slidable coupling 34 that permits the transfer board to be rotated and moved downward from the armrest position shown in FIG. 2 to a transfer position as is shown in FIG. 7. The transfer board is shown in FIG. 7 as extending to a second seating surface 35, such as a bed.

Figure 3:
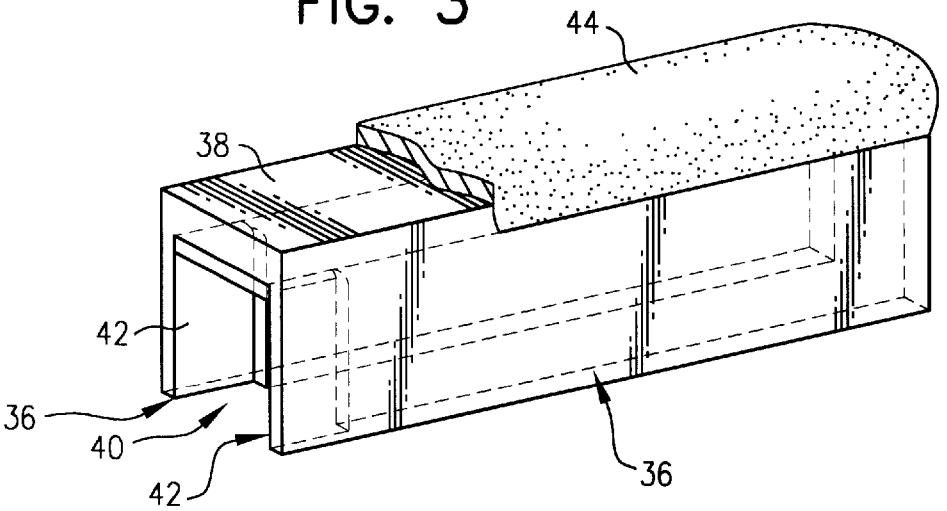
FIG. 3 is a rear side perspective view, with parts removed for detail, of a removable armrest for placement on the transfer board of FIG. 2.

The transfer board 30 is composed of a smooth, lightweight material, preferably a finished wood product. The removable armrest 32 includes two vertical side walls 36 (FIG. 3) and a top 38 which create a longitudinal cavity 40 for receiving the top longitudinal edge of the vertically mounted transfer board 30. Widened slots 42 are located at the rear portion of the longitudinal cavity 40, the purpose of which will be discussed in detail below. A cushion 44 extends along the top 38 of the armrest 32 for providing comfort for a wheelchair passenger.

A front mount 46 and a rear mount 48 are provided for attaching the transfer board 30 to the wheelchair 10. The front mount 46 fits over the front armrest receiving cylinder 26A and is configured to receive the front end of the transfer board and the coupling 34. The rear mount 48 fits over the rear armrest receiving cylinder 26B and secures the back end of the transfer board 30 when the transfer board is in the stowed position of FIG. 2. The front and rear mounts 46, 48 may be held in place by a bolt (not shown) or similar fastener.

The coupling 34 secures the transfer board 30 to the front mount 46. As can best be seen in FIG. 4, the coupling 34 includes a plate 50 which attaches to a circular reinforcement 51 on the transfer board 30. The plate 50 and the circular reinforcement 51 are securely fastened to the transfer board 30 by screws, bolts or similar fasteners. Mounted at the center of the plate 50 is an annular bearing 52. The annular bearing 52 includes a plurality of ball bearings (not shown, but known in the art) housed between a stationary race 56 and a rotatable race 58.

Figure 4:
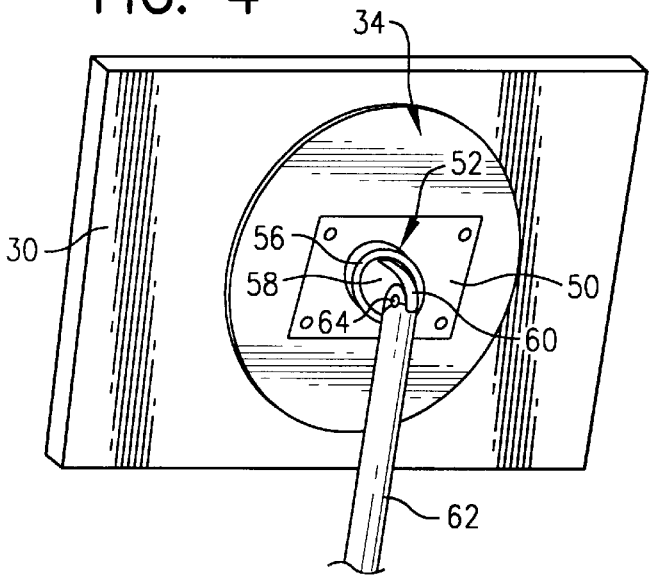
FIG. 4 is a side perspective view of a coupling with parts removed for detail for attaching the transfer board of FIG. 2 to the wheelchair.

As shown in FIG. 4, a flange 60 extends transversely from the rotatable race 58. A dowel 62 is rotatably attached to the flange 60 by a pin 64 or similar attachment. Other types of attachments or configurations may be used for providing preferably 180° pivotal movement of the dowel 62 relative to the transfer board 30.

Figure 5:
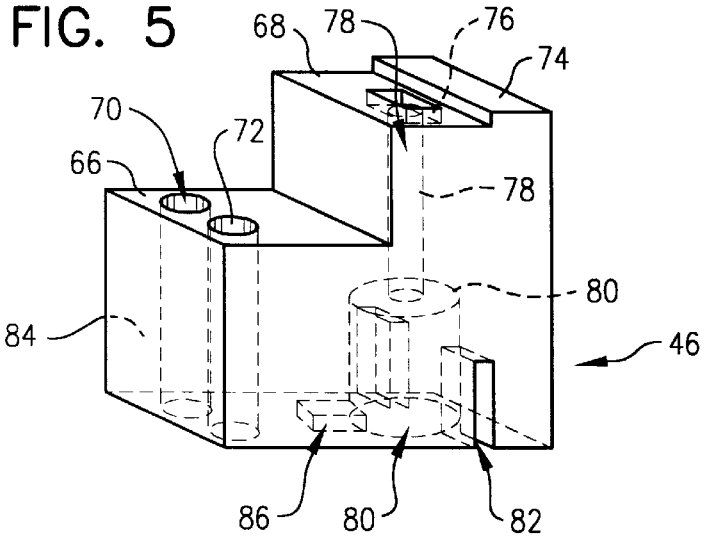
FIG. 5 is a side perspective view of a front mount for attaching the coupling of FIG. 4 to the wheelchair of FIG. 2.

The front mount 46 is set forth in detail in FIG. 5. As discussed earlier, the front mount 46 is configured to fit upon the front armrest receiving cylinder 26A. As shown by FIG. 5, the front mount 46 includes a short end 66 extending next to a tall end 68. Two dowel guide holes 70, 72 are bored vertically through the short end 66 and are positioned laterally adjacent to each other. The tall end 68 includes a raised ridge 74 extending along the top rear lateral edge. Also at the top of the tall end 68 is a bolt head insertion slot 76. The bolt head insertion slot 76 leads to a cylindrical channel 78 that descends vertically towards the bottom of the front mount 46. Approximately at the midpoint of the tall end 68, the cylindrical channel 78 opens to a larger hollowed cylinder 80, which extends to the bottom of the tall end 68. The hollowed cylinder 80 is preferably the same height, or slightly less than the height, of the front armrest receiving cylinder 26A of the wheelchair 10. Two rectangular slots 82, 84 extend from opposite sides of hollowed cylinder 80 to the sides of the front mount 46. The rectangular slots 82, 84 extend vertically from the bottom of the tall end 68 approximately ¾ the length of the hollowed cylinder 80. A third slot 86 extends from the forward portion of the hollowed cylinder 80 along the center of the bottom of the front mount 46 toward the dowel guide holes 70, 72. Preferably, the third slot 86 extends from the bottom of the tall end 68 about ⅓ the distance up the hollowed cylinder 80.

To install the front mount 46, the short end 66 is aligned toward the rear end of the wheelchair 10, and the hollowed cylinder 80 is placed over the forward armrest receiving cylinder 26A of the wheelchair. Rotation of the front mount 46 about the axis central to hollowed cylinder 80 is prevented by engagement of the rectangular slots 82, 84 with a connector (not shown, but well known in the art) attaching the forward armrest receiving cylinder 26A to the frame of the wheelchair 10. The third slot 86 receives external spring locks (not shown, but well known in the art) included on the armrest receiving cylinders 26A, 26B of some wheelchairs.

To secure the front mount 46 in place, a bolt (not shown) is inserted into the cylindrical channel 78. The head of the bolt is held securely by head insertion slot 76. A washer (not shown) and a nut (also not shown) are placed over the end of the bolt extending out of the bottom of the forward armrest receiving cylinder 26A and the front mount is tightened securely in place.

To mount the coupling 34 and the transfer board 30 on the front mount 46, the dowel 62 is inserted downward through either of two dowel guide holes 70, 72. If desired, the dowel 62 may include an attachment at its bottom end that is larger than the diameter of the dowel guide holes 70, 72, thus not allowing removal of the dowel 62 from the front mount 46.

The dowel 62 is then rotated relative to the transfer board 30 until the dowel extends along the side of the transfer board in a direction which is transverse to the longitudinal axis of the transfer board. With this relationship established between the transfer board 30 and the coupling 34, the transfer board extends along the left side of the seating surface 11 of the wheelchair 10 in the armrest position shown in FIG. 2.

The attachment of the transfer board 30 to the wheelchair 10 via the front mount 46 and the coupling 34 makes transfer much easier for a wheelchair occupant. The pivotal mounting of the dowel 62 relative to the flange 60 permits the transfer board 30 to rotate about its longitudinal axis. In addition, the swivel mounting of the rotatable race 58 relative to the stationary race 56 allows the transfer board 30 to rotate about the dowel 62. Also, the dowel 62 can slide up and down in the front mount 46, allowing the transfer board 30 to be lowered to the level of the seating surface 11 of the wheelchair 10. It also allows the unit to be raised in the vertical position providing clearance for the board to be pivoted, from the coupling 34, and inserted or removed form the rear mount 48. Thus, the attachment of the transfer board 30 to the wheelchair 10 via the front mount 46 and the coupling 34 permits a variety of different arrangements for the transfer board 30, all in which the transfer board is stabilized by its attachment to the wheelchair. This attachment prevents the transfer board 30 from sliding off the wheelchair during body transfers. It also lessens the length of the transfer board 30 required for placement underneath the transferee at the beginning of a transfer.

Figure 6:
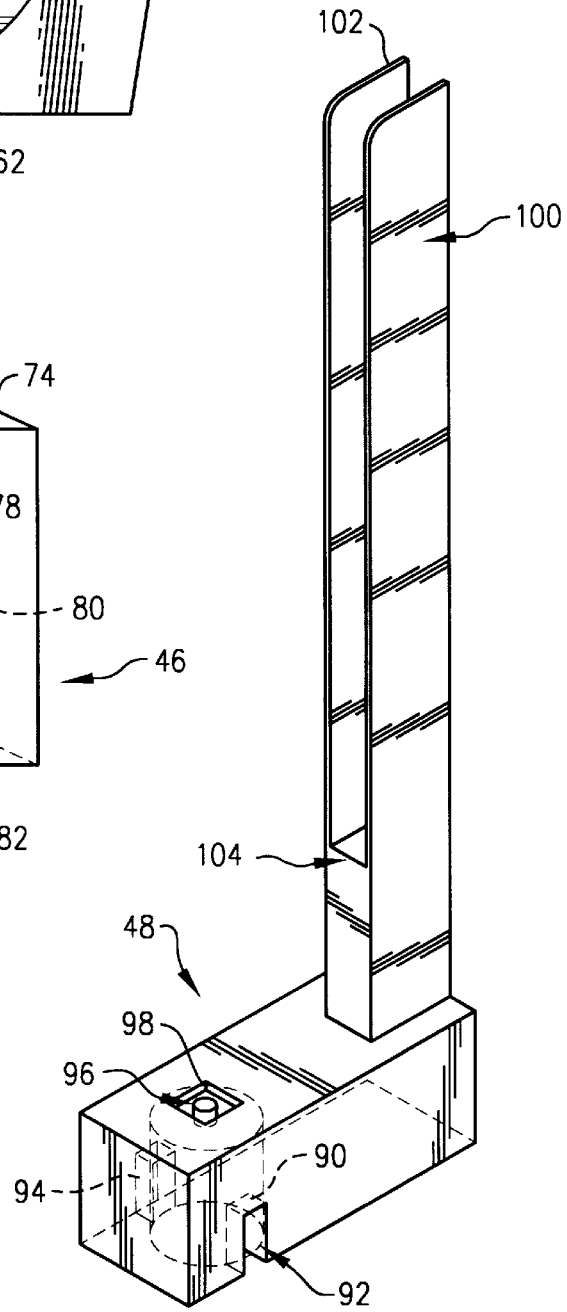
FIG. 6 is a side perspective view of the rear mount for receiving the back end of the transfer board of FIG. 2.

Referring to FIG. 6, the rear mount 48 is an L-shaped piece that mounts on the rear receiving cylinder 26B. The rear mount 48 includes a hollowed cylinder 90 with side slots 92 and 94 that receive the rear armrest receiving cylinder 26B and are similar to that found on front mount 46. A cylindrical channel 96 extends along the vertical centerline of the hollowed cylinder 90 to a bolt insertion slot 98 that opens at the top of the base of the L-shaped rear mount 48. Extending from the base of the rear mount 48 are two parallel guides 100 and 102. The parallel guides 100 and 102 are joined at their lower ends such that a shelf 104 is formed. The parallel guides 100 and 102 are separated by a distance which is slightly greater than the width of the transfer board 30.

Similar to the front mount 46, the hollowed cylinder 90 fits over the wheelchair's rear armrest receiving cylinder 26B. Rotation of the rear mount 48 around the receiving cylinder 26B is prevented by the coupling of the side slots 92, 94 and the vertical connector between the frame of the wheelchair 10 and the receiving cylinder 26B. A bolt (not shown) fits through channel 96 to fasten the rear mount 48 securely to the receiving cylinder 26B. The head of the bolt is refrained from rotation by insertion slot 98. A washer and nut (both not shown) are threaded over the end of the bolt extending out of the bottom of the rear armrest receiving cylinder 26B and the rear mount 48 is tightened securely in place.

The rear mount 48 receives the back end of the transfer board 30 when the transfer board is in the stowed position of FIG. 2. The transfer board 30 rests on the shelf 104 and is supported laterally by the parallel guides 100 and 102. The parallel guides 100 and 102 are positioned behind the back 12 of the wheelchair to prevent injury and to allow for the unrestricted assembly of the wheelchair 10 from a collapsed state. When the transfer board 30 is in place, the removable armrest 32 is placed on the top longitudinal edge of the transfer board 30 and the parallel guides 100 and 102 are matched with the slots 42 in the longitudinal cavity 40 of the removable armrest. The height of the lateral parallel guide 100 could be produced shorter that the medical parallel guide 102. This version, though less compatible with both sides of the wheelchair 10, would provide greater ease for those with tremors or visual impairments to insert the vertical board 30 into the longitudinal cavity 40 in the stowed position.

The above-described combination transfer board 30 and removable armrest 32 provides many advantages not available in prior art transfer boards. Because the transfer board 30 is attached to the wheelchair, the transfer process is stabilized and the risk of the patient failing during the transfer process is minimized. In addition, the transfer board 30 is always readily available, because it is a part of the wheelchair. A patient can access the transfer board 30, manipulate it to the transfer position, and perform a successful transfer without the help of an additional person. Thus, the device provides an independence for the wheelchair occupant which was not available with prior art transfer boards.

Although the transfer board 30 has been described in detail with reference to a wheelchair 10, it is to be understood that the concepts described herein could be used in conjunction with many different seating surfaces, including, but not limited to, a bed, a stationary chair, or any other seating surface. The transfer board may or may not include an armrest in these other applications.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A device for transferring an individual from a first seating surface to a second seating surface, the device comprising:

a transfer board;

a coupling attached to the transfer board and having a rod for slidable and rotatable connection to the first seating surface, the coupling being configured such that the transfer board is (1) pivotable about a pivot joint respective to an attachment point and (2) rotatable about a swivel joint respective to the attachment point, whereby the transfer board can rotate to a variety of different directions relative to the attachment point and is reconfigurable when the coupling is attached to the first seating surface between a first position in which the transfer board extends along one side of the first seating surface and a second position in which the transfer board extends between the first seating surface and the second seating surface whereby the transfer board may aid in transfer of a patient from the first seating surface to the second seating surface; and a rear support for selectively connecting to a rear portion of the transfer board when the transfer board is in the first position.

2. The device of claim 1 wherein the swivel joint and pivot joint are collocated.

3. The device of claim 1 further comprising a removable armrest which is selectively attachable to the transfer board when the transfer board is in the first position.

4. The device of claim 3 wherein the removable armrest comprises a longitudinal cavity for fitting over the transfer board.

5. A device or transferring an individual from a first seating surface to a second seating surface, the device comprising:

a transfer board;

a coupling attached to the transfer board and for attaching to the first seating surface; the coupling comprising
a rod slidably attachable to the first seating surface,
a pivot joint, and
a swivel joint, the rod, the pivot joint and the swivel joint being configured such that when the coupling is associated with the first seating surface, the transfer board is pivotal about the pivot joint, rotatable about the swivel joint, and reconfigurable between a first position in which the transfer board extends along one side of the first seating surface and a second position in which the transfer board extends between the first seating surface and the second seating surface; and a rear structure for selectively supporting a rear portion of the transfer board when the transfer board is in the first position.

6. The device of claim 5, wherein the swivel joint and pivot joint are collocated.

7. The device of claim 5 further comprising a removable armrest which is selectively attachable to the transfer board when the transfer board is in the first position.

8. The device of claim 7 wherein the removeable armrest comprises a longitudinal cavity for fitting over the transfer board.

* * * * *